US006157702A

United States Patent [19]

Reznikov et al.

[11] Patent Number: 6,157,702

[45] Date of Patent: Dec. 5, 2000

[54] X-RAY TUBE TARGETS WITH REDUCED HEAT TRANSFER

[75] Inventors: Gregory Reznikov, Akron, Ohio; Christopher A. Metcalf, San Pedro Garza Garcia Nuevo Leon, Mexico

[73] Assignee: General Electric Company, Milwaukee, Wis.

[21] Appl. No.: 09/148,180

[22] Filed: Sep. 4, 1998

[51] Int. Cl.[7] ..... H01J 35/10

[52] U.S. Cl. ..... 378/144; 378/121

[58] Field of Search ..... 378/144, 121

[56] References Cited

U.S. PATENT DOCUMENTS

| | | | |
|---|---|---|---|
| 4,777,643 | 10/1988 | Devine, Jr. | 378/144 |
| 5,498,187 | 3/1996 | Eggleston et al. . | |
| 5,592,525 | 1/1997 | Reznikov et al. . | |
| 5,655,000 | 8/1997 | Benz et al. . | |
| 5,742,123 | 4/1998 | Nagayama | 313/623 |

*Primary Examiner*—David V. Bruce
*Assistant Examiner*—Pamela R. Hobden
*Attorney, Agent, or Firm*—B. Joan Haushalter; Christian G. Cabou; Phyllis Y. Price

[57] ABSTRACT

In an X-ray tube target, a shaft is welded to the anode target, the shaft typically being TZM or a molybdenum alloy. This defines a first weld location and creates an integral shaft-target assembly. The shaft-target assembly is then machined. A heat sink material, such as graphite, is brazed to the integral shaft-target assembly. A hub is then welded to the shaft, at an end opposite the target, defining a second weld location and creating a hub-target assembly. The hub can be columbium or columbium alloy. Subsequently, the hub-target assembly can be machined. Having a dual weld procedure, and eliminating the subsequent brazing step to join the hub to the shaft, enables the alloys to maintain their high strength without annealing, thereby allowing the shaft materials to keep their high strength and reducing plastic deformation at the lower (hub) portion of the shaft.

12 Claims, 2 Drawing Sheets

X-RAY TUBE TARGETS WITH REDUCED HEAT TRANSFER

TECHNICAL FIELD

The present invention relates to rotating X-ray tubes and, more particularly, to an improvement in service life and performance of an X-ray tube and target.

BACKGROUND OF THE INVENTION

The X-ray tube has become essential in medical diagnostic imaging, medical therapy, and various medical testing and material analysis industries. Typical X-ray tubes are built with a rotating anode structure for the purpose of distributing the heat generated at the focal spot. The anode is rotated by an induction motor consisting of a cylindrical rotor built into a cantilevered axle that supports the disc shaped anode target, and an iron stator structure with copper windings that surrounds the elongated neck of the X-ray tube that contains the rotor. The rotor of the rotating anode assembly being driven by the stator which surrounds the rotor of the anode assembly is at anodic potential while the stator is referenced electrically to ground. The X-ray tube cathode provides a focused electron beam which is accelerated across the anode-to-cathode vacuum gap and produces X-rays upon impact with the anode.

In an X-ray tube device with a rotatable anode, the target has previously consisted of a disk made of a refractory metal such as tungsten, and the X-rays are generated by making the electron beam collide with this target, while the target is being rotated at high speed. Rotation of the target is achieved by driving the rotor provided on a support shaft extending from the target. Such an arrangement is typical of rotating X-ray tubes and has remained relatively unchanged in concept of operation since its introduction.

However, the operating conditions for X-ray tubes have changed considerably in the last two decades. Due to continuous demands from radiologists for higher power from X-ray tubes, more and more tubes are using composite rotating anodes with tungsten-rhenium as a layer, molybdenum alloys as a substrate, and brazed graphite as a heat sink. Application of the inertia welding process, disclosed in U.S. Pat. No. 5,592,525, totally incorporated herein by reference, helps to eliminate problems associated with attachment of the stem to the target; however, higher power applied to the target leads to more heat traveling to the lower portion of the integral target-stem assembly and hence to the bearing, which adversely affects tube life. For some applications, the temperature is so high that stresses existing between the target flange and the mating thermobarrier lead to plastic deformation of TZM shaft. This TZM shaft does not have sufficient strength due to recrystallization which occurs during the brazing of graphite to the target cap at 1600–1800 C. As a result of high temperature at the bottom portion and plastic deformation of the target shaft, unbalance takes place, which in turn leads to premature failure of the tube.

It would be desirable then to have an improved X-ray tube target assembly design with reduced heat transfer to overcome problems associated with prior art structures and for improving the service life of an X-ray tube target.

BRIEF SUMMARY OF THE INVENTION

The present invention provides an improved target-stem design for a rotating anode of an X-ray tube wherein columbium or columbium alloys comprise the hub that is welded to the shaft of molybdenum alloy. Heat transfer through the shaft can be reduced by using a tubular configuration. However, with constantly increasing target diameters (and weight), structural strength of the shaft becomes the critical factor, limiting the reduction of the cross section of the shaft. This is worsened by the fact that the integral target-shaft assembly undergoes a high temperature treatment during the brazing operation of the graphite to the metal portion of the target (with a typical temperature of 1600–1800 C.). This operation reduces the strength of the shaft, allowing plastic deformation of the lower portion of the stem to occur; which problem is addressed by the present invention.

In accordance with one aspect of the present invention, a method for making an X-ray tube having a rotating anode assembly comprises the steps of providing a cathode which emits electrons and providing an anode target which radiates X-ray in response to bombardment by the electrons.

Accordingly, it is an object of the present invention to provide a rotating anode structure for an X-ray tube. It is a further object of the present invention to reduce heat transfer of the anode target.

Other objects and advantages of the invention will be apparent from the following description, the accompanying drawings and the appended claims.

DETAILED DESCRIPTION OF THE INVENTION

The present invention relates to rotating X-ray tubes which employ a rotating anode assembly and a cathode assembly. The purpose of this invention is to reduce the heat transfer through the X-ray tube shaft, thereby improving service life of the X-ray tube assembly.

Figure 1:
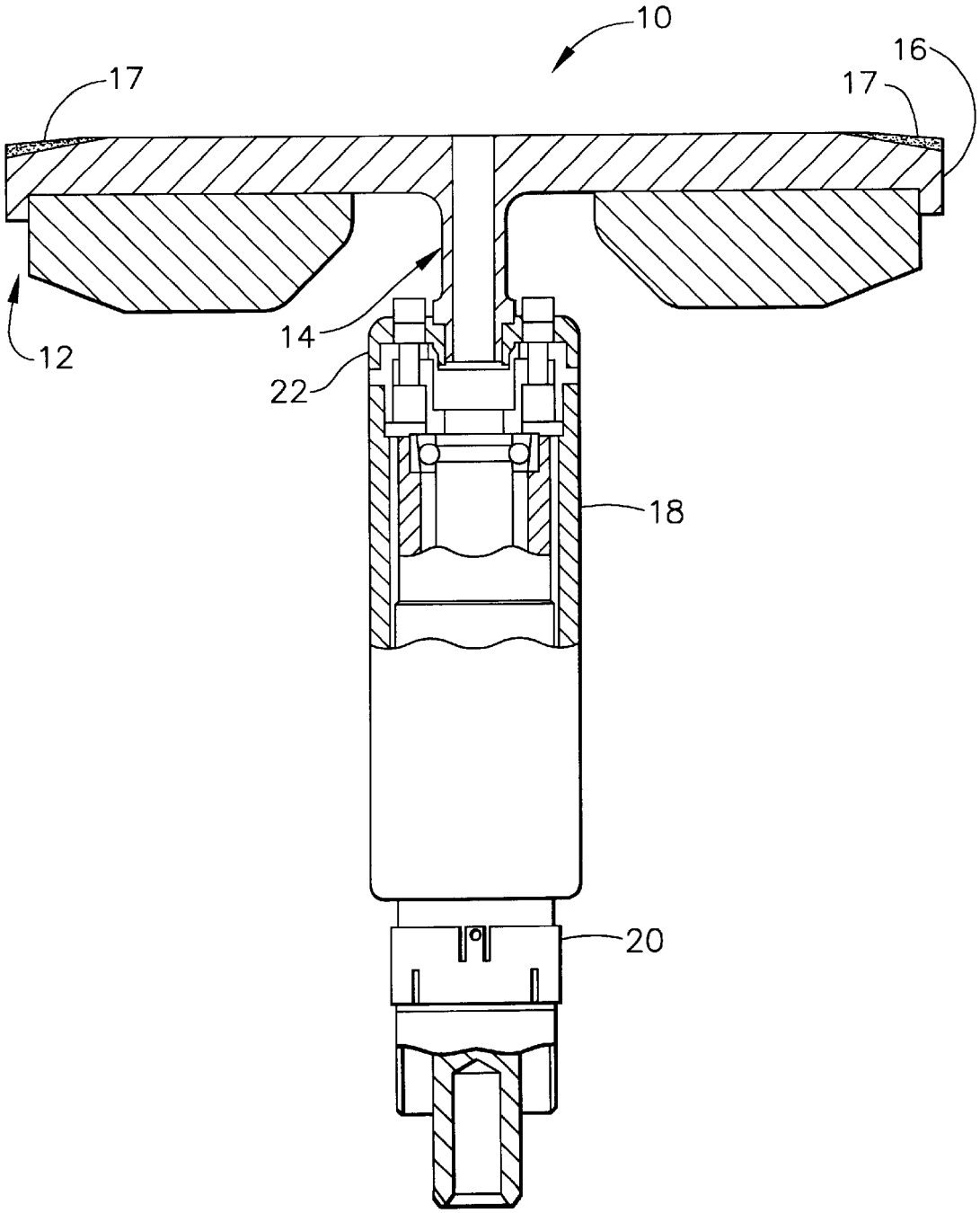
FIG. 1 (PRIOR ART)
FIG. 1 is a prior art cross-sectional illustration of a typical X-ray tube.

Referring now to the drawings, FIG. 1 illustrates a typical prior art X-ray tube 10. The X-ray tube 10 is typically built with a rotating anode assembly 12, with an associated target and shaft (or stem) assembly 14, for the purpose of distributing the heat generated at a focal spot. The anode assembly 12 is rotated by an induction motor comprising a cylindrical rotor 18 built around a cantilevered axle 20. The cantilevered axle 20 supports a disc shaped anode target 16, typically comprising a tungsten-rhenium area 17 for generating X-rays, and a graphite portion operating as a heat sink. The target 16 is connected via the stem and hub portion 22 to rotor 18 and cantilevered axle 20, which contains bearings facilitating rotation. The rotor 18 of the rotating anode assembly 12, driven by a stator of the induction motor, is at anodic potential while the stator is referenced electrically to ground.

In a typical assembly, the anode assembly and a cathode assembly are sealed in a glass frame and mounted in a conductive metal housing. An insulation material is provided between the stator, and the glass frame and rotor. A typical X-ray tube 10 further comprises an X-ray tube cathode assembly (not shown) for providing a focused electron beam which is accelerated across a large anode-to-cathode vacuum gap and producing X-rays upon impact with the anode.

In prior art assemblies, such as is illustrated in FIG. 1, the shaft is welded to the target; the shaft of the integral shaft-target assembly is then machined; graphite is brazed to the integral shaft-target assembly; and a hub, typically a nickel alloy, is brazed to the bottom of the shaft. However, with higher power being applied to the target, more heat is traveling to the lower portion (i.e., the hub portion) of the integral shaft-target assembly and, hence, to the bearing, associated with cantilevered axle 20, thereby adversely affecting tube life.

Figure 2:
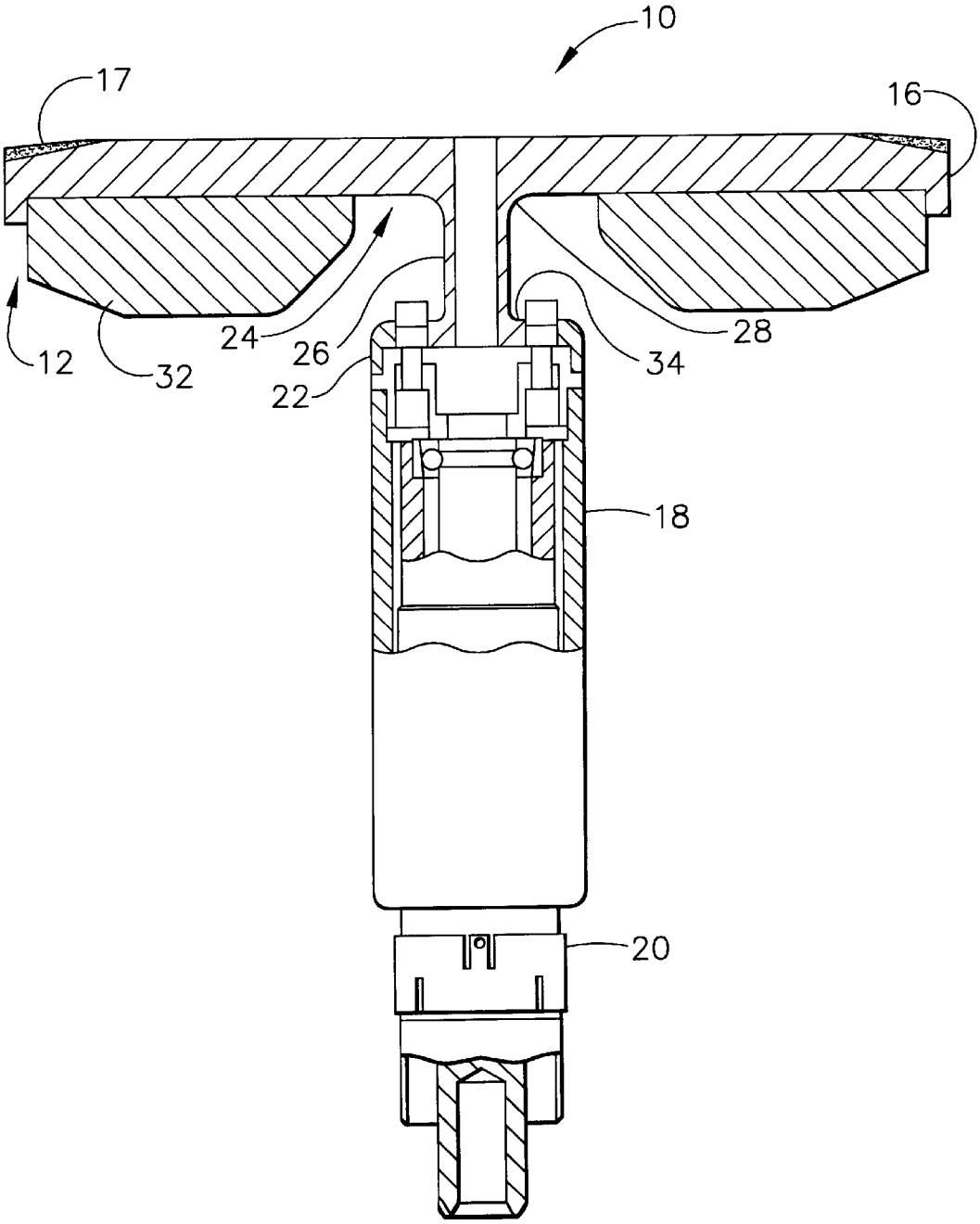
FIG. 2 is a cross-sectional view of an X-ray tube constructed in accordance with the present invention.

The present invention proposes to overcome these problems by using columbium or columbium alloys as the hub material of the hub-target assembly welded to the shaft, and molybdenum alloy as the lower portion of the shaft. Referring now to FIG. 2, the present invention provides for a significant improvement in the high temperature performance of the target assembly, referenced as number 24 in FIG. 2. As can be seen in FIG. 2, a shaft 26 is welded to target 24 at a first weld location 28. The target (cap) 24 may then be machined in preparation for a subsequent brazing step. A graphite disk 32 for dissipating heat is then brazed to the cap 24. This has the desirable effect of increasing the volume of the anode without significantly increasing the weight of the anode target assembly. A second weld is then made at weld location 34 to join a columbium or columbium alloy hub of shaft-hub assembly 22, to the end of shaft 26 opposite the target 24. Machining to desired geometry or flange design can then be done, depending on the particular application.

The present invention proposes, in particular, replacing the step of brazing the hub to the shaft with the step of welding the hub to the shaft. In accordance with the advantages realized by such a step, the present invention further proposes using columbium or columbium alloys for the hub portion of the shaft-target assembly. Such materials (columbium and columbium alloy) feature significantly lower thermal conductivity than TZM or other molybdenum alloy, which typically comprise the remainder of the shaft. This allows the shaft to have sufficient cross section (structurally), while considerably reducing heat transfer to the bearing.

In a preferred embodiment of the present invention, the shaft is attached to the cap (target) after brazing the graphite to the cap, so as to not subject the columbium material to brazing temperature and atmospheric conditions. The present invention allows the inertia welding process to be used after the graphite has been brazed. It is further in accordance with the present invention to confirm the feasibility of attaching columbium and/or columbium alloy stems to the brazed target without damaging the brazed joint integrity.

The present invention proposes to improve the high temperature performance of an X-ray tube target. In the prior art, the stem is welded to the target; the stem of the integral stem-target assembly is then machined; graphite is brazed to the integral stem-target assembly; and a hub, typically a nickel alloy, is brazed to the bottom of the stem. However, with higher power being applied to the target, more heat is traveling to the lower portion of the integral stem-target assembly and, hence, to the bearing, thereby adversely affecting tube life.

The present invention proposes to overcome these problems by using columbium or columbium alloy as the hub portion of the shaft-target assembly, resulting in a sequence as follows: the TZM or molybdenum alloy shaft is welded to the target; the integral shaft-target assembly is machined; graphite is brazed to the shaft-target assembly; then a second weld is applied to join the columbium/columbium ally hub to the shaft end opposite the target.

The procedure according to the present invention, reduces the heat transfer through the shaft and allows the columbium or columbium alloy to maintain its high strength without being subjected to brazing temperatures. The present invention has the advantage of reducing plastic deformation of the lower portion of the shaft (i.e., the hub area) and allows the use of reduced cross sections, which in turn will reduce heat transfer to the bearing associated with the cantilevered axle, and increase tube life.

It will be obvious to those skilled in the art that various modifications and variations of the present invention are possible without departing from the scope of the invention, which proposes replacing the step of brazing the hub to the shaft with the step of welding the hub to the shaft. For example, another possible solution, within the scope of the invention, is welding suitable molybdenum alloys (such as TZM, Alloy 2, HCM, ZHM, Ta—Hf—Zr alloys, etc.) to the brazed target, also after the graphite has been brazed to the cap. Subsequent avoidance of recrystallization treatment will allow the shaft materials to keep their high strength and reduce plastic deformation of the lower portion of the stem and therefore increase tube life.

The invention has been described in detail with particular reference to certain preferred embodiments thereof, but it will be understood that modifications and variations can be effected within the spirit and scope of the invention.

What is claimed is:

1. A method for making a rotating X-ray tube having a cathode and further having an anode assembly, the anode assembly including an anode target, the method comprising the steps of:

welding a shaft to the anode target at a first weld location to create an integral shaft-target assembly, the first weld location defining a first end area of a stem;

subsequently brazing a heat sink to the integral shaft-target assembly; and welding a hub to a second end area of the shaft at a second weld location to create a hub-target assembly.

2. A method as claimed in claim 1 wherein the hub portion of the hub-target assembly comprises a columbium material.

3. A method as claimed in claim 1 wherein the hub portion of the hub-target assembly comprises a columbium alloy material.

4. A method as claimed in claim 1 wherein a lower portion of the shaft comprises a molybdenum alloy and the hub portion of the hub-target assembly comprises columbium or columbium alloy.

5. A method for reducing heat transfer through a shaft of an X-ray tube assembly, the method comprising the steps of:

providing a cathode which emits electrons;

providing an anode target which radiates X-ray in response to bombardment by the electrons;

welding a shaft to the anode target at a first weld location to create an integral shaft-target assembly, the first weld location defining a first end area of the shaft, a lower portion of the shaft being made of a molybdenum alloy material;

brazing a heat sink to the integral shaft-target assembly; and defining a second weld location at a second end of the shaft to join a hub to the shaft to create a hub-target assembly, the hub being made of a columbium or columbium allots material the hub material thereby having lower thermal conductivity than the molybdenum alloy material of the lower portion of the shaft.

6. A method as claimed in claim 5 wherein the heat sink comprises graphite.

7. A rotating X-ray tube having a cathode and further having an anode assembly, the anode assembly including an anode target, the X-ray tube comprising:

a shaft welded to the anode target at a first weld location to create an integral shaft-target assembly, the first weld location defining a first end area of the shaft;

a heat sink brazed to the integral shaft-target assembly; and a hub welded to a second end of the shaft at a second weld location to create a hub-target assembly.

8. A rotating X-ray tube as claimed in claim 7 wherein a lower portion of the shaft comprises a molybdenum alloy.

9. A rotating X-ray tube as claimed in claim 7 wherein the hub comprises columbium material.

10. A rotating X-ray tube as claimed in claim 7 wherein the hub comprises a columbium alloy.

11. A rotating X-ray tube as claimed in claim 7 wherein the heat sink comprises graphite.

12. A rotating X-ray tube as claimed in claim 11 wherein the graphite is brazed to the integral stem-target assembly.

* * * * *